United States Patent [19]

Matsuo

[11] Patent Number: 5,066,942

[45] Date of Patent: Nov. 19, 1991

[54] ANTITHEFT DEVICE FOR ARTICLES

[75] Inventor: Toichiro Matsuo, Arao, Japan

[73] Assignee: Matsuo Sangyo Kabushiki Kaisha, Omuta, Japan

[21] Appl. No.: 580,674

[22] Filed: Sep. 11, 1990

[30] Foreign Application Priority Data

Jun. 1, 1990 [JP] Japan ..... 2-58580[U]

[51] Int. Cl.[5] ..... G08B 13/02

[52] U.S. Cl. ..... 340/568; 361/170

[58] Field of Search ..... 340/568, 571, 540, 546, 340/548; 361/170; 116/67

[56] References Cited

U.S. PATENT DOCUMENTS

| | | | |
|---|---|---|---|
| 3,127,597 | 3/1964 | Lewin et al. | 340/568 |
| 3,596,265 | 7/1971 | Garland | 340/568 |
| 4,293,852 | 10/1981 | Rogers | 340/568 |
| 4,916,434 | 4/1990 | McNeely | 340/568 |

FOREIGN PATENT DOCUMENTS

| | | |
|---|---|---|
| 39-24125 | 8/1964 | Japan . |
| 54-143189 | 3/1978 | Japan . |
| 58-15282 | 7/1981 | Japan . |
| 60-164289 | 10/1985 | Japan . |

*Primary Examiner*—Glen R. Swann, III

*Attorney, Agent, or Firm*—Armstrong, Nikaido, Marmelstein, Kubovcik & Murray

[57] ABSTRACT

An antitheft device for articles includes a plurality of article connection cords, a cord connection part including a plurality of terminal parts which are connected in series and are closed by the connection to the cords, respectively, and a monitor part which is connected to the cord connection part, and which is not to operate when the terminal parts are closed and which is to operate when at least one of the terminal parts opens. The antitheft device further includes an auxiliary alarm device connected to at least one of the terminal parts in the cord connection part, and a drive device for driving the auxiliary alarm device corresponding to the terminal part or parts which open when the monitor part raises an alarm. In the device, it is possible to rapidly and specifically find when an article is stolen or when an attempt to steal was made or when the article connection cord is disengaged or loosened.

6 Claims, 2 Drawing Sheets

ANTITHEFT DEVICE FOR ARTICLES

BACKGROUND OF THE INVENTION

There are various types of antitheft devices for goods or articles of trade, one of which is disclosed in Japanese Utility Model Publication (unexamined) No. 60-164289. It includes a plurality of article connection cords, a cord connection part including a plurality of terminal parts which are connected in series and are closed by the connection to the cords, respectively, and a monitor part which is connected to the cord connection part, and is adapted not to operate when the terminal parts are closed and is adapted to operate when at least one of the terminal parts opens.

In this antitheft device for articles, each terminal part in the cord connection part is connected to the article connection cord to close the terminal part. The cords are also connected to the articles, so that alarm means may operate in the monitor part when the cord is cut or disengaged from the terminal part due to the stealing of the article or the attempt thereof.

However, this prior device includes a plurality of terminal parts in the cord connection part and a plurality of article connection cords connected to the terminal parts, so that it is difficult to immediately and specifically find or determine the stolen article as well as the terminal part and cord connected thereto, even when the monitor part raises the alarm. Further, in addition to the case of the stealing, for example, when a customer touches and takes the article to see it, the cord may disengage or loosen to actuate the alarm means in the monitor part, in which case it is necessary to immediately restore that cord connection, otherwise stealing of other articles will not be found.

SUMMARY OF THE INVENTION

Accordingly, it is an object of the invention to provide an antitheft device for articles which comprises a plurality of article connection cords, a cord connection part including a plurality of terminal parts which are connected in series and are closed by the connection to the cords, respectively, and a monitor part which is connected to the cord connection part, and is adapted not to operate when the terminal parts are closed and is adapted to operate when at least one of the terminal parts opens; and is operable to rapidly and specifically indicate the article which is stolen or an attempt to steal was made, or the article connection cord has become disengaged or loosened.

In accordance with the above mentioned object, the present invention provides an antitheft device for articles which comprises a plurality of article connection cords, a cord connection part including a plurality of terminal parts which are connected in series and are closed by the connection to the cords, respectively, and a monitor part which is connected to the cord connection part, and is adapted not to operate when the terminal parts are closed and is adapted to operate when at least one of the terminal parts opens; and further comprises an auxiliary alarm device connected to at least one of the terminal parts in the cord connection part, and a drive device for driving the auxiliary alarm device corresponding to the terminal part or parts which open when the monitor part raises an alarm.

The auxiliary alarm device may be arranged at each of the terminal parts, or may be arranged at one or some of the terminal parts.

Each article connection cord may include continuous line for short-circuiting the terminal part or may include a switch which is arranged in a line for short-circuiting the terminal part, and can be associated to the article to close.

Each auxiliary alarm device may be connected directly to the terminal part without the article connection cord therebetween, or may be connected thereto through the article connection cord, if the cord include e.g., the switch. In this case the auxiliary alarm device may be associated with the switch.

The auxiliary alarm device may be a light emitting diode.

In the antitheft device for articles according to the invention, some terminal parts in the cord connection part are short-circuited by the article connection cords connected to the articles. The remaining terminal parts are short-circuited by an appropriate short-circuiting device.

In these structures, when any article is stolen or an attempt to steal the article was made or a customer takes the article to see it, the connection cord for this article may be cut, disengaged from the terminal part, or loosened, or the switch associated to with the cord may be disengaged from the article or loosened at the attachment to the article, and thus the switch may open. In such cases, the monitor part raises an alarm, and the auxiliary alarm device, if associated with the article under an extraordinary condition, operates so that a guard can immediately and specifically find the article under the extraordinary condition.

Further, when the monitor part raises the alarm, but any auxiliary alarm device does not operate, the extraordinary condition can be specifically found more rapidly than the prior arts by checking the remaining articles to which the auxiliary alarm device is not associated.

Other objects and advantages of the present invention will become more apparent from the following detailed description, when taken in conjunction with the accompanying drawings which show, for the purpose of illustration only, one embodiment in accordance with the present invention.

DETAILED DESCRIPTION OF THE PREFERRED EMBODIMENTS

An embodiment of the invention will now be described with reference to the drawings.

Figure 1:
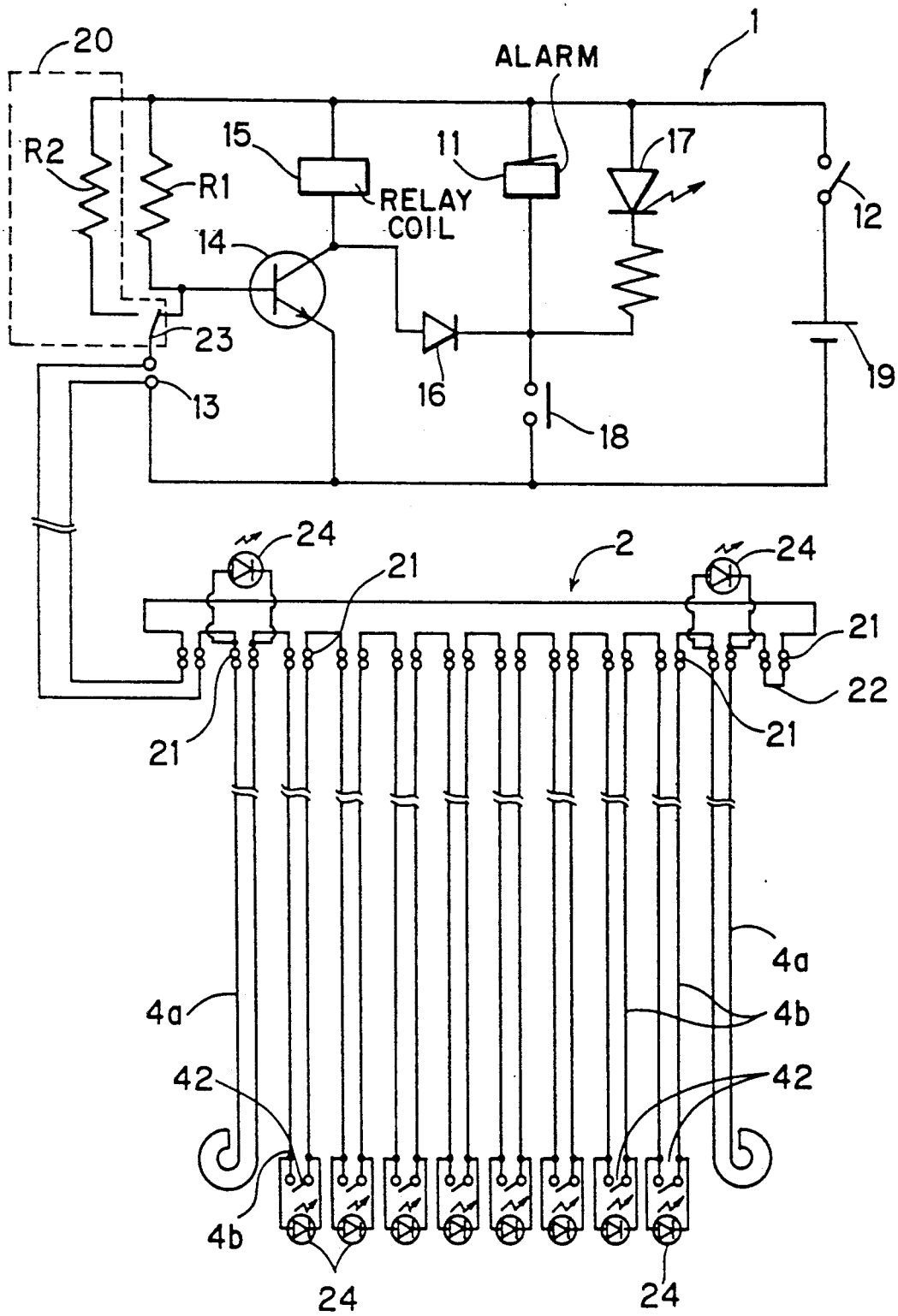
FIG. 1 is a circuit diagram of an antitheft device embodying the present invention.

FIG. 1 is a diagram illustrating the entire circuit in an antitheft device for articles according to the invention. The antitheft device for articles includes a monitor part 1, a cord connection part 2 connected to the monitor part 1, and article connection cords 4*a* and 4*b* connected to the connection part 2.

The monitor part 1 includes alarm means, e.g., a buzzer 11 and a light emitting diode 17, which are connected to an electric power source 19 through a main switch 12 at one side and a normally open contact 18 at the other side, respectively. The power source 19 is connected to a transistor 14 and a relay coil 15, and is also connected to a terminal part 13 for the cord connection part 2 through a resistor R1 connected to transistor 14 and also through a relay contact 23. Numeral 16 denotes a diode.

In this monitor part, when the main switch 12 is in a closed condition, and a terminal part 13 is opened, the transistor 14 becomes conductive and the relay coil 15 is excited to close the normally open contact 18 by self-holding, so that the buzzer 11 sounds and the light emitting diode 17 lights up. This condition is maintained until the switch 12 is opened even if the terminal part 13 is re-short-circuited. Although the power source 19 in the illustrated embodiment is a battery, other power sources may be used, if desired.

The cord connection part 2 includes a series of terminal parts 21 of a plug-in type and is connected to the terminal part 13 in the monitor part 1.

Figure 2:
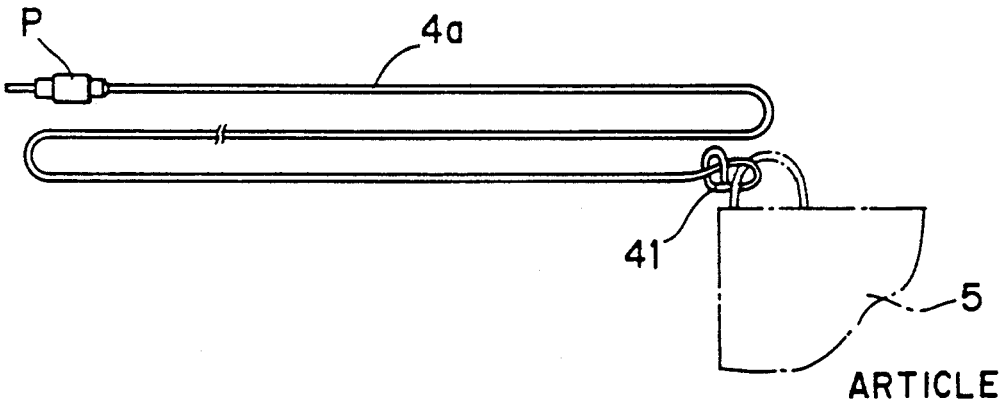
FIG. 2 is a view illustrating an article connection cord in the device.
Figure 3:
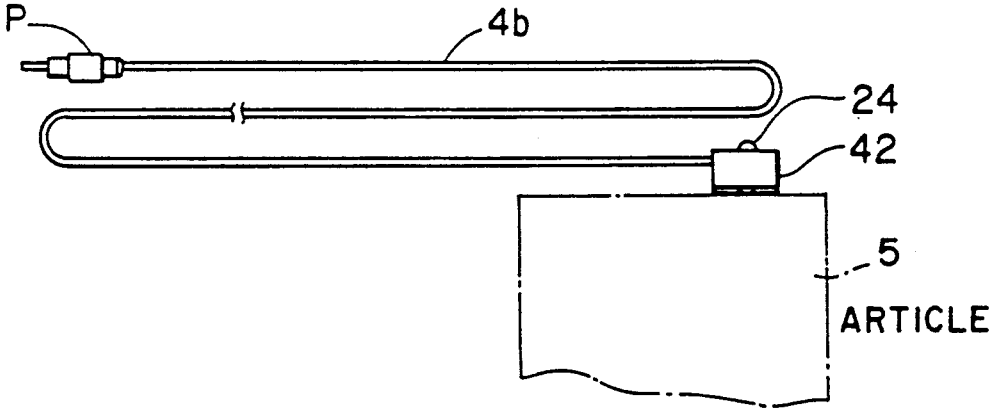
FIG. 3 is a view illustrating another article connection cord in the device.

Each article connection cord 4*a* includes, as shown in FIGS. 2 and 3, a plug P input into the terminal part 21 and a continuous line connected to this plug P.

Each cord 4*b* includes, as shown in FIGS. 1 and 3, a plug P input into the terminal part 21 and a line connected to a plug P and including a switch 42 at the middle thereof.

The illustrated embodiment further includes auxiliary alarm means, e.g., light emitting diodes 24 and a drive 20 for driving them.

The light emitting diode 24 is connected to each terminal part 21 in the cord connection part 2.

Among these diodes 24, those associated to the terminal parts 21 connected to the cords 4*a* are directly connected to the terminal parts 21, as shown in FIG. 1, respectively.

The diodes 24 which are associated to the terminal parts 21 connected to the cords 4*b* are connected to opposite terminals of the switches 42 and are connected to the terminal parts 21 through the cords 4*b* respectively. Thus, the diodes 24 are associated with the switches 42 (see FIG. 3). However, the diodes 24 can be directly connected to the terminal parts 21 connected to the cords 4*b*.

The drive 20 includes a resistor R2, which is connected at one side through the main switch 12 to the power source 19 and at the other side to the terminal part 13 through the relay contact 23. The resistor R2 is so designed that a voltage enough to light the diode 24 is applied to it, when the relay contact 23 is closed at the side of the resistor R2, and the relay contact 23 is closed at the side of the transistor 14 in the ordinary condition. When the terminal part 13 is released from the short-circuiting condition due to extraordinary circumstances, the relay contact 23 is turned to close at the side of the resistor R2 due to the turn-on of the relay coil 15 and is kept in the self-holding condition to apply the voltage to the diode 24 corresponding to the article under the extraordinary condition.

The device in the embodiment described above can prevent the theft of the articles as follows:

First of all, an appropriate number of the article connection cords 4*a* and/or 4*b* are prepared in compliance with the number of the articles. The plugs P thereof are, as shown in FIG. 1, connected to some terminal parts 21 in the cord connection part 2 to close and short-circuit the terminal parts 21. Other terminal parts 21 are short-circuited by appropriate short-circuiting means 22, e.g., the cord 4*a* which are not connected to the articles.

The cords 4*a* are, as shown in FIG. 2, tied at the ends 41 thereof to the articles 5, respectively. The switches 42 of the cords 4*b* are attached, as shown in FIG. 3, to the articles 5 by adhesive or the like and are closed, respectively.

After this setting, if any article 5 is stolen or an attempt is made to steal the article, or a customer touches or takes the article to see it, the connection cord 4*a* or 4*b* for this article may be cut, disengaged at the terminal part 21 or loosened. Further, the switch 42 may be removed from the article 5 or loosen at the attachment to the article 5 to open. In any of these cases, the alarm buzzer 11 in the monitor part 2 sounds, the light emitting diode 17 lights up and the light emitting diode 24 corresponding to the article under the extraordinary condition also lights up, so that a guard can immediately and specifically find the article.

According to the invention, in the antitheft device for articles which comprises a plurality of article connection cords, a cord connection part including a plurality of terminal parts which are connected in series and are closed by the connection to the cords, respectively, and a monitor part which is connected to the cord connection part, and is adapted not to operate when the terminal parts are closed and is adapted to operate when at least one of the terminal parts opens, it is possible to rapidly and specifically find when an article is stolen or an attempt to steal or the article was made when the article connection cord is disengaged or loosened.

What is claimed is:

1. An antitheft device for articles comprising:

a plurality of article connection cords, each cord connected to a respective article;

a cord connection part including a plurality of terminal parts connected in series by connection to said plurality of cords, respectively;

a monitor part connected to said cord connection part, such that said monitor part will not operate when said terminal parts are connected in series by said cords and will operate when a) at least one of said terminal parts is disconnected from said cords or b) when at least one of said cords is cut or loosened;

auxiliary alarm means connected in parallel to at least one of the terminal parts in said cord connection part; and drive means for driving said auxiliary alarm means, corresponding to said terminal part or parts which is disconnected, when said monitor part outputs an alarm.

2. An antitheft device for articles according to claim 1 wherein at least one of said terminal parts is connected directly to said auxiliary alarm means.

3. An antitheft device for articles according to claim 1 wherein at least one of said article connection cords includes a switch, which is closed when said cord is connected to a protected article, and said auxiliary alarm means, associated with said terminal part to which the cord including said switch is connected, is connected in parallel to the terminal part through the cord.

4. An antitheft device for articles according to claim 3 wherein said auxiliary alarm means is associated with said switch.

5. An antitheft device for articles according to claim 1 wherein said monitor part includes a primary alarm means for warning.

6. An antitheft device for articles according to claim 1 wherein said auxiliary alarm means is connected to said terminal parts through at least one of said plurality of article connection cords.

* * * * *